US006302337B1

(12) United States Patent
Kimmel

(10) Patent No.: US 6,302,337 B1
(45) Date of Patent: Oct. 16, 2001

(54) SEALING ARRANGEMENT FOR AIR ASSIST FUEL INJECTORS

(75) Inventor: James Allen Kimmel, Williamsburg, VA (US)

(73) Assignee: Synerject, LLC, Newport News, VA (US)

( * ) Notice: Subject to any disclaimer, the term of this patent is extended or adjusted under 35 U.S.C. 154(b) by 0 days.

(21) Appl. No.: 09/644,798

(22) Filed: Aug. 24, 2000

(51) Int. Cl.[7] ..... B05B 7/12; B05B 1/30; F02M 51/00

(52) U.S. Cl. ..... 239/408; 239/585.1; 239/585.4

(58) Field of Search ..... 239/408, 585.1, 239/585.2, 585.3, 585.4, 585.5

(56) References Cited

U.S. PATENT DOCUMENTS

| | | | |
|---|---|---|---|
| Re. 34,945 | | 5/1995 | Sayer et al. . |
| 3,300,672 | | 1/1967 | Fisher . |
| 4,124,003 | | 11/1978 | Abe et al. . |
| 4,434,766 | | 3/1984 | Matsuoka et al. . |
| 4,448,160 | * | 5/1984 | Vosper ..... 123/297 |
| 4,462,760 | | 7/1984 | Sarich et al. . |
| 4,516,548 | | 5/1985 | May . |

(List continued on next page.)

FOREIGN PATENT DOCUMENTS

| | | |
|---|---|---|
| B1-21034/77 | 7/1978 | (AU) . |
| B1-26285/77 | 1/1979 | (AU) . |
| B-62857/80 | 4/1981 | (AU) . |
| B-66453/81 | 8/1981 | (AU) . |
| A1-71108/81 | 12/1981 | (AU) . |
| A-54978/90 | 1/1991 | (AU) . |
| A-45546/96 | 11/1996 | (AU) . |

(List continued on next page.)

OTHER PUBLICATIONS

Orbital, "Automotive 4–Stroke", http://www.orbeng/com.au/tech/di4ssae.htm.

Orbital, "Automotive 2–Stroke", http:/www.orbeng/com.au/tec/di2ssae.htm.

Orbital, "Orbital Direct Injected Four Stroke Technology", pp. 1–2, Printed Apr. 15, 1999, http://www.orbeng/com.au/tech/di4ssae.htm.

Dr. Rodney Houston et al., "Direct Injection 4–Stroke Gasoline Engines, the Orbital Combustion Process Solution", presented at ImechE Euro IV Challenge Future Techologies and Systems Conference, Dec. 4, 1997, London, England, pp. 1–17.

Dave Worth et al., "Design Considerations for the Application of Air Assisted Direct In–Cylinder Injection Systems", SAE 972074, Presented by Nicholas Coplin to the Small Engine Technology Conference in Yokohama, Japan, Oct. 28, 1997, pp. 1–21.

Sam Leighton et al., "The Orbital Combustion Process for Future Small Two–Stroke Engines", Presented at Institut Francais du Petrole International Seminar: A New Generation of Two–Stroke Engines for the Future?, Rueil Malmaison, France, Nov. 29–30, 1993.

(List continued on next page.)

*Primary Examiner*—Kevin Shaver
*Assistant Examiner*—Davis Hwu
(74) *Attorney, Agent, or Firm*—Cooley Godward, LLP

(57) ABSTRACT

A sealing arrangement for an air assist fuel injector having an interface cap. The sealing arrangement includes a sleeve sealingly attached to a leg of the air assist fuel injector and that receives at least a portion of the interface cap. A seal member abuts the sleeve to seal a solenoid from liquid fuel and gas and to seal an interface between the air assist fuel injector and a rail when the air assist fuel injector is received by the rail.

30 Claims, 6 Drawing Sheets

U.S. PATENT DOCUMENTS

| | | | | |
|---|---|---|---|---|
| 4,519,356 | | 5/1985 | Sarich . | |
| 4,527,520 | | 7/1985 | Koch . | |
| 4,546,748 | * | 10/1985 | Karino et al. | 123/494 |
| 4,554,945 | | 11/1985 | McKay . | |
| 4,561,405 | | 12/1985 | Simons . | |
| 4,574,754 | * | 3/1986 | Rhoades, Jr. | 123/298 |
| 4,674,462 | | 6/1987 | Koch et al. . | |
| 4,693,224 | | 9/1987 | McKay . | |
| 4,712,524 | | 12/1987 | Smith et al. . | |
| 4,719,880 | | 1/1988 | Schlunke et al. . | |
| 4,753,213 | | 6/1988 | Schlunke et al. . | |
| 4,754,735 | | 7/1988 | Simons . | |
| 4,754,739 | | 7/1988 | Czwienczek et al. . | |
| 4,759,335 | | 7/1988 | Ragg et al. . | |
| 4,760,832 | | 8/1988 | Smith et al. . | |
| 4,781,164 | | 11/1988 | Seeber et al. . | |
| 4,790,270 | | 12/1988 | McKay et al. . | |
| 4,794,901 | | 1/1989 | Hong et al. . | |
| 4,794,902 | | 1/1989 | McKay . | |
| 4,800,862 | | 1/1989 | McKay et al. . | |
| 4,803,968 | | 2/1989 | Czwienczek et al. . | |
| 4,807,572 | | 2/1989 | Schlunke . | |
| 4,817,873 | | 4/1989 | McKay . | |
| 4,825,828 | | 5/1989 | Schlunke et al. . | |
| 4,841,942 | | 6/1989 | McKay . | |
| 4,844,040 | | 7/1989 | Leighton et al. . | |
| 4,844,339 | | 7/1989 | Sayer et al. . | |
| 4,867,128 | | 9/1989 | Ragg et al. . | |
| 4,886,021 | | 12/1989 | Seeber et al. . | |
| 4,901,687 | | 2/1990 | Jones . | |
| 4,920,745 | | 5/1990 | Gilbert . | |
| 4,920,932 | | 5/1990 | Schlunke . | |
| 4,924,820 | | 5/1990 | Lear et al. . | |
| 4,926,806 | | 5/1990 | Ahern et al. . | |
| 4,934,329 | | 6/1990 | Lear et al. . | |
| 4,936,279 | | 6/1990 | Ragg . | |
| 4,938,178 | | 7/1990 | Schlunke et al. . | |
| 4,945,886 | | 8/1990 | McKay et al. . | |
| 4,949,689 | | 8/1990 | Schlunke . | |
| 4,989,557 | | 2/1991 | Penney . | |
| 4,993,394 | | 2/1991 | McKay et al. . | |
| 5,018,498 | | 5/1991 | Hoover . | |
| 5,024,202 | | 6/1991 | McKay . | |
| 5,090,625 | | 2/1992 | Davis . | |
| 5,091,672 | | 2/1992 | Below . | |
| 5,094,217 | | 3/1992 | Kaku et al. . | |
| 5,113,829 | | 5/1992 | Motoyama . | |
| 5,115,786 | | 5/1992 | Yamada . | |
| 5,123,399 | | 6/1992 | Motoyama et al. . | |
| 5,150,836 | | 9/1992 | McKay et al. . | |
| 5,163,405 | | 11/1992 | Ahern et al. . | |
| 5,170,766 | * | 12/1992 | Haas et al. | 123/531 |
| 5,195,482 | | 3/1993 | Smith . | |
| 5,205,254 | | 4/1993 | Ito et al. . | |
| 5,209,200 | | 5/1993 | Ahern et al. . | |
| 5,220,301 | | 6/1993 | Haas et al. . | |
| 5,245,974 | | 9/1993 | Watson et al. . | |
| 5,251,597 | | 10/1993 | Smith et al. . | |
| 5,265,418 | | 11/1993 | Smith . | |
| 5,267,545 | | 12/1993 | Kitson . | |
| 5,279,327 | | 1/1994 | Alsobrooks et al. . | |
| 5,291,822 | | 3/1994 | Alsobrooks et al. . | |
| 5,315,968 | | 5/1994 | Niebrzydoski . | |
| 5,358,181 | | 10/1994 | Tani et al. . | |
| 5,377,630 | | 1/1995 | Schlunke et al. . | |
| 5,377,637 | | 1/1995 | Leighton et al. . | |
| 5,379,731 | | 1/1995 | Sayer . | |
| 5,381,816 | | 1/1995 | Alsobrooks et al. . | |
| 5,392,828 | | 2/1995 | Watson et al. . | |
| 5,398,654 | | 3/1995 | Niebrzydoski . | |
| 5,403,211 | | 4/1995 | Sayer et al. . | |
| 5,427,083 | | 6/1995 | Ahern . | |
| 5,441,019 | | 8/1995 | Sayer et al. . | |
| 5,477,833 | | 12/1995 | Leighton . | |
| 5,477,838 | | 12/1995 | Schlunke et al. . | |
| 5,483,944 | | 1/1996 | Leighton et al. . | |
| 5,494,223 | * | 2/1996 | Hall et al. | 239/585.5 |
| 5,516,309 | | 5/1996 | Sayer et al. . | |
| 5,527,150 | | 6/1996 | Windhofer . | |
| 5,531,206 | | 7/1996 | Kitson et al. . | |
| 5,540,205 | | 7/1996 | Davis et al. . | |
| 5,546,902 | | 8/1996 | Paluch et al. . | |
| 5,551,638 | | 9/1996 | Caley . | |
| 5,558,070 | | 9/1996 | Bell et al. . | |
| 5,560,328 | | 10/1996 | Bell et al. . | |
| 5,588,415 | | 12/1996 | Ahern . | |
| 5,593,095 | | 1/1997 | Davis et al. . | |
| 5,606,951 | | 3/1997 | Southern et al. . | |
| 5,615,643 | | 4/1997 | Hill . | |
| 5,622,155 | | 4/1997 | Ellwood et al. . | |
| 5,655,365 | | 8/1997 | Worth et al. . | |
| 5,655,715 | | 8/1997 | Hans et al. . | |
| 5,685,492 | | 11/1997 | Davis et al. . | |
| 5,692,723 | | 12/1997 | Baxter et al. . | |
| 5,694,906 | | 12/1997 | Lange et al. . | |
| 5,709,177 | | 1/1998 | Worth et al. . | |
| 5,730,108 | | 3/1998 | Hill . | |
| 5,730,367 | | 3/1998 | Pace et al. . | |
| 5,794,600 | | 8/1998 | Hill . | |
| 5,803,027 | | 9/1998 | Bell et al. . | |
| 5,806,304 | | 9/1998 | Price et al. . | |
| 5,819,706 | | 10/1998 | Tsuchida et al. . | |
| 5,829,407 | | 11/1998 | Watson et al. . | |
| 5,832,881 | | 11/1998 | Karay et al. . | |
| 5,833,142 | | 11/1998 | Caley . | |
| 5,853,306 | | 12/1998 | Worth et al. . | |
| 5,863,277 | | 1/1999 | Melbourne . | |
| 5,899,191 | | 5/1999 | Rabbit et al. . | |
| 5,904,126 | | 5/1999 | McKay et al. . | |
| 5,906,190 | | 5/1999 | Hole et al. . | |
| 5,927,238 | | 7/1999 | Watson . | |
| 5,941,210 | | 8/1999 | Hill et al. . | |
| 5,970,954 | | 10/1999 | Worth et al. . | |
| 5,979,402 | | 11/1999 | Melbourne . | |
| 5,979,786 | | 11/1999 | Longman et al. . | |
| 5,983,865 | | 11/1999 | Yamashita et al. . | |

FOREIGN PATENT DOCUMENTS

| | | |
|---|---|---|
| 38 28 764 A1 | 3/1990 | (DE) . |
| WO 87/00583 | 1/1987 | (WO) . |
| WO 91/11609 | 8/1991 | (WO) . |
| WO 93/23662 | 11/1993 | (WO) . |
| WO 94/15094 | 7/1994 | (WO) . |
| WO 94/28299 | 12/1994 | (WO) . |
| WO 94/28300 | 12/1994 | (WO) . |
| WO 95/01503 | 1/1995 | (WO) . |
| WO 95/11377 | 4/1995 | (WO) . |
| WO 95/26462 | 10/1995 | (WO) . |
| WO 97/02424 | 1/1997 | (WO) . |
| WO 97/02425 | 1/1997 | (WO) . |
| WO 97/09520 | 3/1997 | (WO) . |
| WO 97/12138 | 4/1997 | (WO) . |
| WO 97/19358 | 5/1997 | (WO) . |
| WO 97/22784 | 6/1997 | (WO) . |
| WO 97/22852 | 6/1997 | (WO) . |
| WO 98/01230 | 1/1998 | (WO) . |
| WO 98/01659 | 1/1998 | (WO) . |
| WO 98/01660 | 1/1998 | (WO) . |
| WO 98/01663 | 1/1998 | (WO) . |
| WO 98/01667 | 1/1998 | (WO) . |
| WO 98/05861 | 2/1998 | (WO) . |

| | | |
|---|---|---|
| WO 99/20895 | 4/1999 | (WO) . |
| WO 99/28621 | 6/1999 | (WO) . |
| WO 99/42711 | 8/1999 | (WO) . |
| WO 99/58846 | 11/1999 | (WO) . |
| WO 99/58847 | 11/1999 | (WO) . |
| WO 00/43666 | 7/2000 | (WO) . |

OTHER PUBLICATIONS

Sam Leighton et al., "The OCP Small Engine Fuel Injection System for Future Two–Stroke Marine Engines", SAE Paper 941687, Presented at Society of Automotive Engineers International Off–Highway and Powerplant Congress & Exposition, Milwaukee, Wisconsin, USA, Sep. 12, 1994.

Karl Eisenhauer, "Durability Development of an Automotive Two–Stroke Engine", Presentation at 2$^{nd}$ International Seminar "High Performance Spark Ignition Engines for Passenger Cars", Balsamo, Italy, Nov. 23–24, 1995.

Rod Houston et al., "Development of a Durable Emissions Control System for an Automotive Two–Stroke Engine", SAE Paper 960361, The Society of Automotive Engineers Congress, Detroit, Michigan, Feb. 26–29, 1996.

Nicholas Coplin, "Application of Air Assisted Direct Injection to High Performance Sports Motorcycles", Presented to the Petroleum Authority of Thailand at Seminar on "Engine Technologies to Reduce Emissions from Motorcycles", Mar. 21, 1996, PTT, Bangkok, Thailand.

Greg Bell et al., "Exhaust Emissions Sensitivities with Direct Injection on a 50cc Scooter", SAE Paper 970365, Presented at Sociey of Automotive Engineers SAE International Congress and Exposition, Detroit Michigan, USA Feb. 24, 1997.

Dave Worth et al., "Design Considerations for the Application of Air Assisted Direct In–Cylinder Injection Systems", SAE Paper 972074, Presented by the Nicholas Coplin to the Small Engine Technology Conference in Yokohama, Japan, Oct. 28, 1997.

David Shawcross et al., "Indonesia's Maleo Car, Spearheads Production of a Clean, Efficient and Low Cost, Direct Injected Two–Stroke Engine", Presented at the IPC9 Conference, Nov. 16–21, 1997, Nusa Dua, Bali, Indonesia.

Dr. Rodney Houston et al., "Direct Injection 4–Stroke Gasoline Engines, the Orbital Combustion Process Solution", Presented at ImechE Euro IV Challenge Future Technologies and Systems Conference, Dec. 4, 1997.

Davis Shawcross et al., "A Five–Million Kilometre, 100–Vehicle Fleet Trial, of an Air–Assist Direct Fuel Injected, Automotive 2–Stroke Engine", Society of Automotive Engineers, Inc., 1999.

David Shawcross, "A High Mileage Extended Duration Fleet Trial of Orbital's Direct Fuel Injection Automotive Two–Stroke Engine", Presentation at Engine Expo 99, Hamburg, Germany, Jun. 8–10, 1999.

Dr. Herbert Stocker et al., "Air Assisted Gasoline Direct Injection", Presented at Eurogress Aachen–Automobile and Engine Technology Conference, Aachen, Germany, Oct. 5–7, 1998.

Ramon Newmann, "Orbital's Air Assisted Direct Injection Combustion Applied to the Automotive Multi–Cylinder Gasoline Four–Stroke Engine", Presentation at Engine Expo 99, Hamburg, Germany, Jun. 1999.

Nicholas Coplin, "Simplification of Air Assisted Direct Injection via Performance Benchmarking", Presented at the Small Engine Technology Conference, Madison, Wisconsin, Oct. 29, 1999.

"On the Road to DI Fuel Economy Gains" Orbital Direct Injection, A Technology Update from the Orbital Engine Corporation, Mar. 2000.

Nicholas Coplin, "Air Assisted Gasoline Direct Injection—A Breath of Fresh Air", Presentation at Engine Expo 2000, Hamburg, Germany, Jun. 2000.

"A Breath of Fresh Air–Air Assisted Direct Fuel Injection—the System of Choice for Low Emissions and Good Fuel Economy", Orbital Engine Corporation, Presented at the Society of Automotive Engineers Congress, Detroit, Michigan, Mar. 6–9, 2000.

Geoffrey Cathcart et al., "Fundamental Characteristics of an Air–Assisted Direct Injection Combustion System as Applied to 4 Stroke Automotive Gasoline Engines", Presented at Society of Automotive Engineers Congress, Mar. 6–9, 2000.

David R. Bowden et al., "NVH Characteristics of Air Assisted Direct Injected (DI) Spark Ignition Four Stroke Engines", Presented at the ImechE European Conference on Vehicle Noise and Vibration 2000, May 10–12, 2000.

* cited by examiner

SEALING ARRANGEMENT FOR AIR ASSIST FUEL INJECTORS

BACKGROUND OF THE INVENTION

1. Field of the Invention

The present invention relates to air assist fuel injectors, and, more particularly, to a sealing arrangement for air assist fuel injectors having an interface cap.

2. Description of the Related Art

Conventional fuel injectors are configured to deliver a quantity of fuel to a combustion cylinder of an engine. To increase combustion efficiency and decrease pollutants, it is desirable to atomize the delivered fuel. Generally speaking, atomization of fuel can be achieved by supplying high pressure fuel to conventional fuel injectors, or atomizing low pressure fuel with pressurized gas, i.e., "air assist fuel injection."

Conventional air assist fuel injectors are typically mounted to a rail, which houses a conventional fuel injector and also defines a mount for the air assist fuel injector. The conventional fuel injector and the rail are configured such that a metered quantity of fuel is delivered from the fuel injector to the air assist fuel injector. Additionally, the rail includes a number of passageways that deliver pressurized air to the air assist fuel injector. The air assist fuel injector atomizes the low pressure fuel with the pressurized air and conveys the air and fuel mixture to the combustion chamber of an engine.

The pressurized air from the rail and the metered quantity of fuel from the conventional fuel injector typically enter the conventional air assist fuel injector through an inlet in the center of an armature. Thereafter, the fuel and air travel through the interior of a poppet, and exit the poppet through slots near the head of the poppet. The poppet is attached to the armature, which is actuated by energizing a solenoid. When the solenoid is energized, the armature will overcome the force of a spring and move toward a leg. Because the poppet is attached to the armature, the head of the poppet will lift off a seat so that a metered quantity of atomized fuel is delivered to the combustion chamber of an engine.

Because liquid fuel and air travel through conventional air assist fuel injectors, it is desirable to seal the solenoid of such air assist fuel injectors from the conveyed liquid fuel and air. It is also desirable to seal the interface between each air assist fuel injector and the rail to prevent liquid fuel and air from leaking to an area outside the air assist fuel injector, such as to an engine compartment of a vehicle. The solenoid of most conventional air assist fuel injectors is sealed from the liquid fuel and gas by multiple o-rings located in the solenoid of the air assist fuel injector. Unfortunately, this configuration increases the size of the air assist fuel injector, which is problematic given the strict space constraints of many internal combustion engine applications.

Other conventional air assists fuel injectors do not incorporate multiple o-rings within the solenoid, but instead provide an o-ring between a flange of a sleeve and the rail to define an axial seal. This configuration attempts to seal the solenoid from the liquid fuel and gas and also attempts to seal the interface between the air assist fuel injector and the rail. However, this axial seal configuration is prone to leak when subject to vibration, such as that associated with some internal combustion applications. Furthermore, this conventional seal configuration is also not suitable for air assist fuel injectors that utilize an interface cap for the liquid fuel and air.

SUMMARY

In light of the previously described problems associated with conventional air assist fuel injectors, one object of embodiments of the present invention is to provide an air assist fuel injector having an interface cap and that reliably seals the interface between the air assist fuel injector and a rail. A further object of the embodiments of the present invention is to provide an air assist fuel injector having an interface cap and that reliably seals a solenoid of the air assist fuel injector from liquid fuel and gas.

Other objects, advantages and features associated with the embodiments of the present invention will become more readily apparent to those skilled in the art from the following detailed description. As will be realized, the invention is capable of other and different embodiments and its several details are capable of modification in various obvious aspects, all without departing from the invention. Accordingly, the drawings and the description are to be regarded as illustrative in nature, and not limitative.

DESCRIPTION OF SPECIFIC EMBODIMENTS

Figure 7:
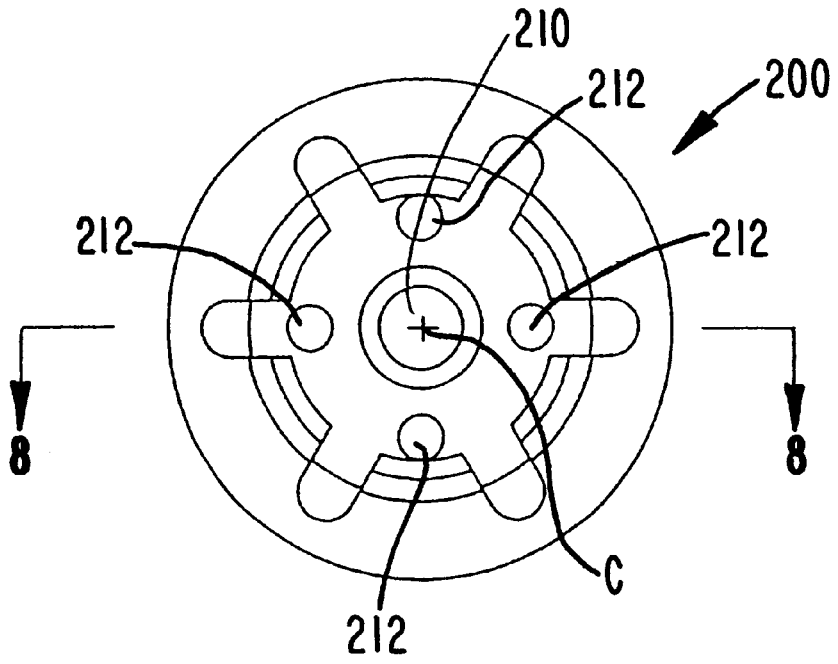
FIG. 7 is a top view of the cap of the air assist fuel injector illustrated in FIG. 1.
Figure 8:
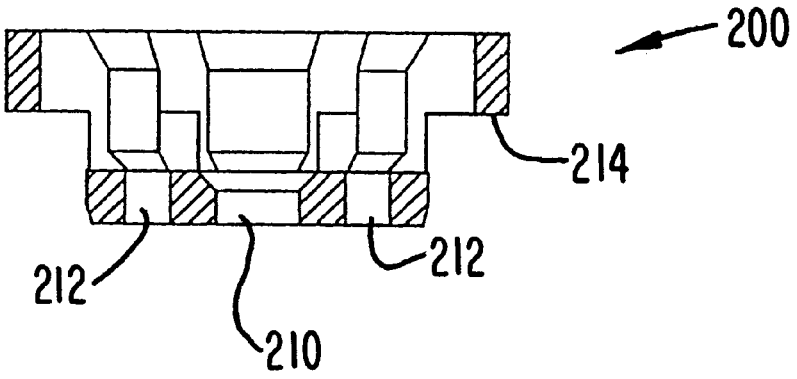
FIG. 8 is a cross-sectional view of the cap illustrated in FIG. 7 taken along the line 8—8 in FIG. 7.
Figure 9:
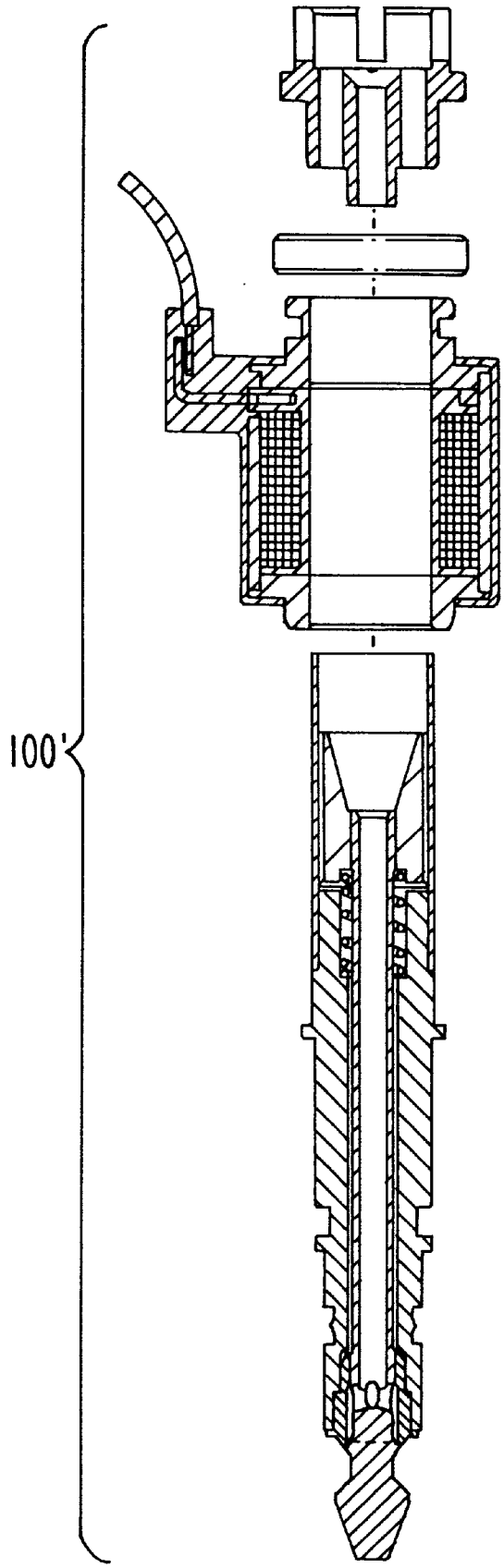
FIG. 9 is an exploded cross-sectional view of an air assist fuel injector in accordance with another embodiment of the present invention.

FIGS. 1–8 illustrate one embodiment of an air assist fuel injector 100 according to the present invention. The air assist fuel injector 100 is configured for use with a two stroke internal combustion engine. However, alternative embodiments of the air assist fuel injector are configured for operation with other engines. For example, FIG. 9 illustrates an embodiment of an air assist fuel injector 100' according to the present invention, configured for operation with a four stroke internal combustion engine. The following discussion of the features, functions, and benefits of the air assist fuel injector 100 also applies to the air assist fuel injector 100'.

Figure 2:
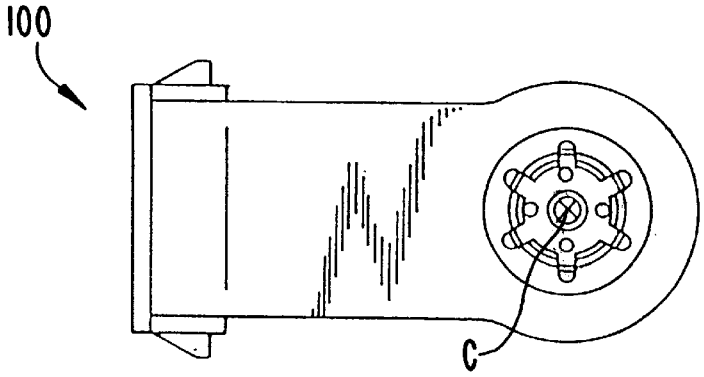
FIG. 2 is a top view of the air assist fuel injector illustrated in FIG. 1.
Figure 1:
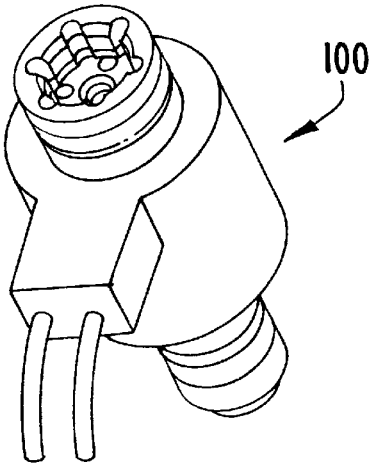
FIG. 1 is a perspective view of an air assist fuel injector in accordance with one embodiment of the present invention.
Figure 3:
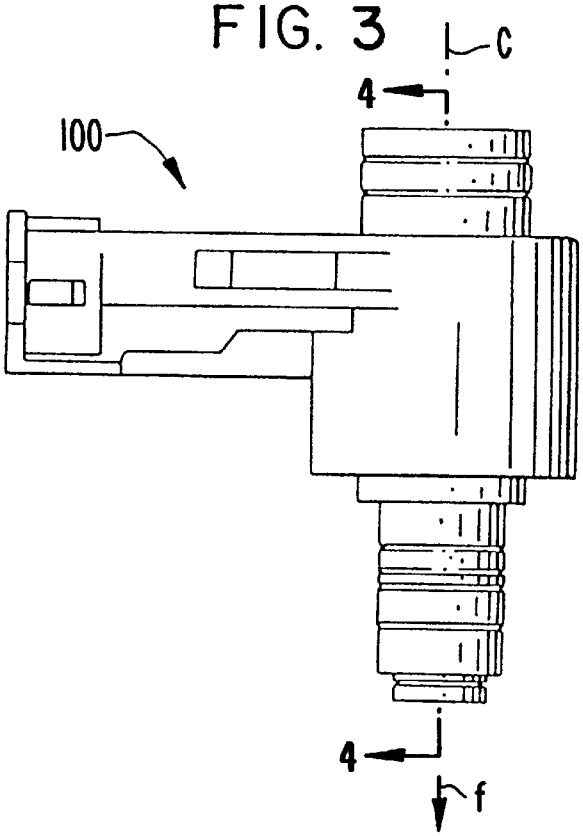
FIG. 3 is a side view of the air assist fuel injector illustrated in FIG. 1.
Figure 4:
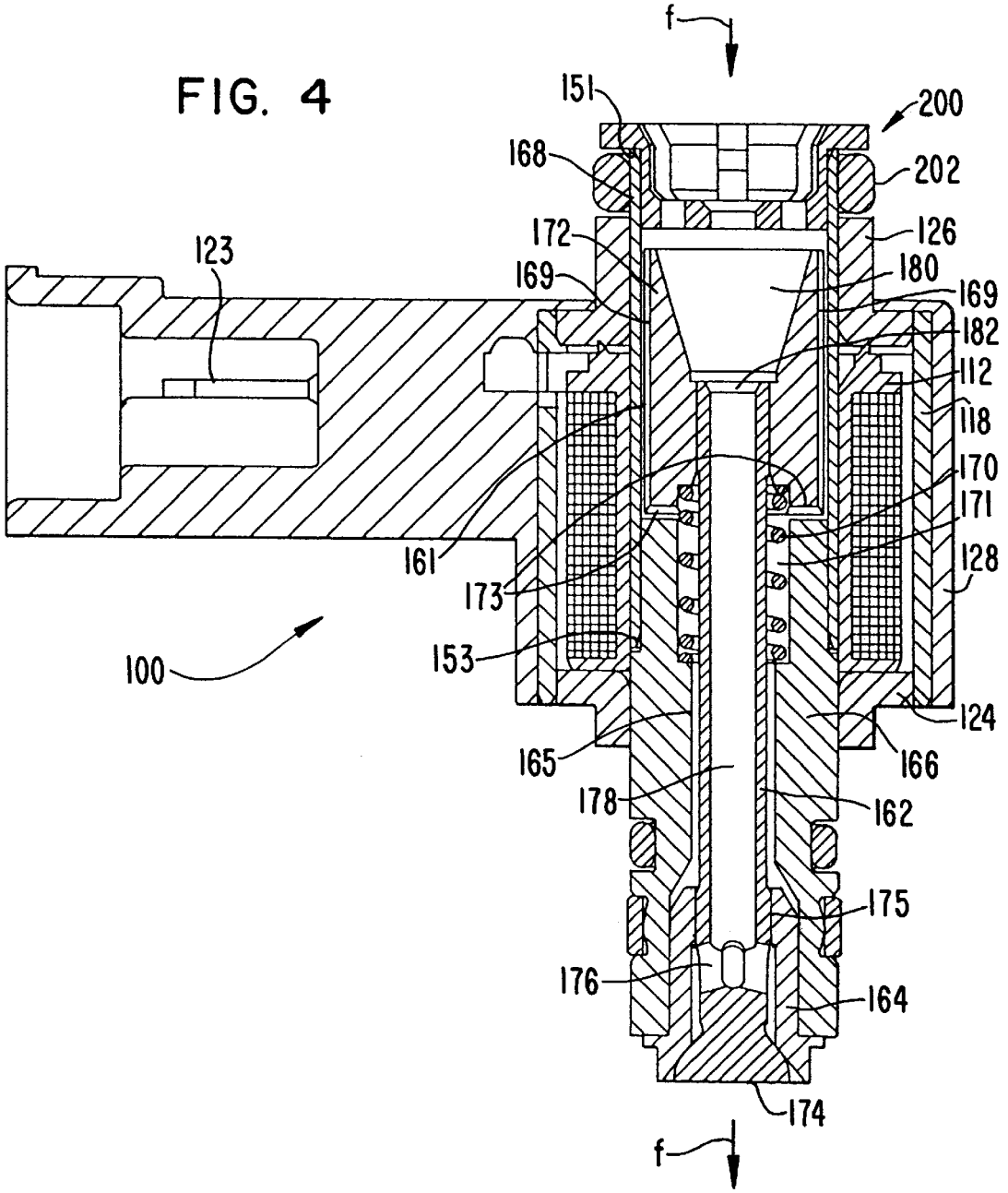
FIG. 4 is a cross-sectional view of the air assist fuel injector illustrated in FIG. 1 taken along the line 4—4 in FIG. 3.
Figure 5:
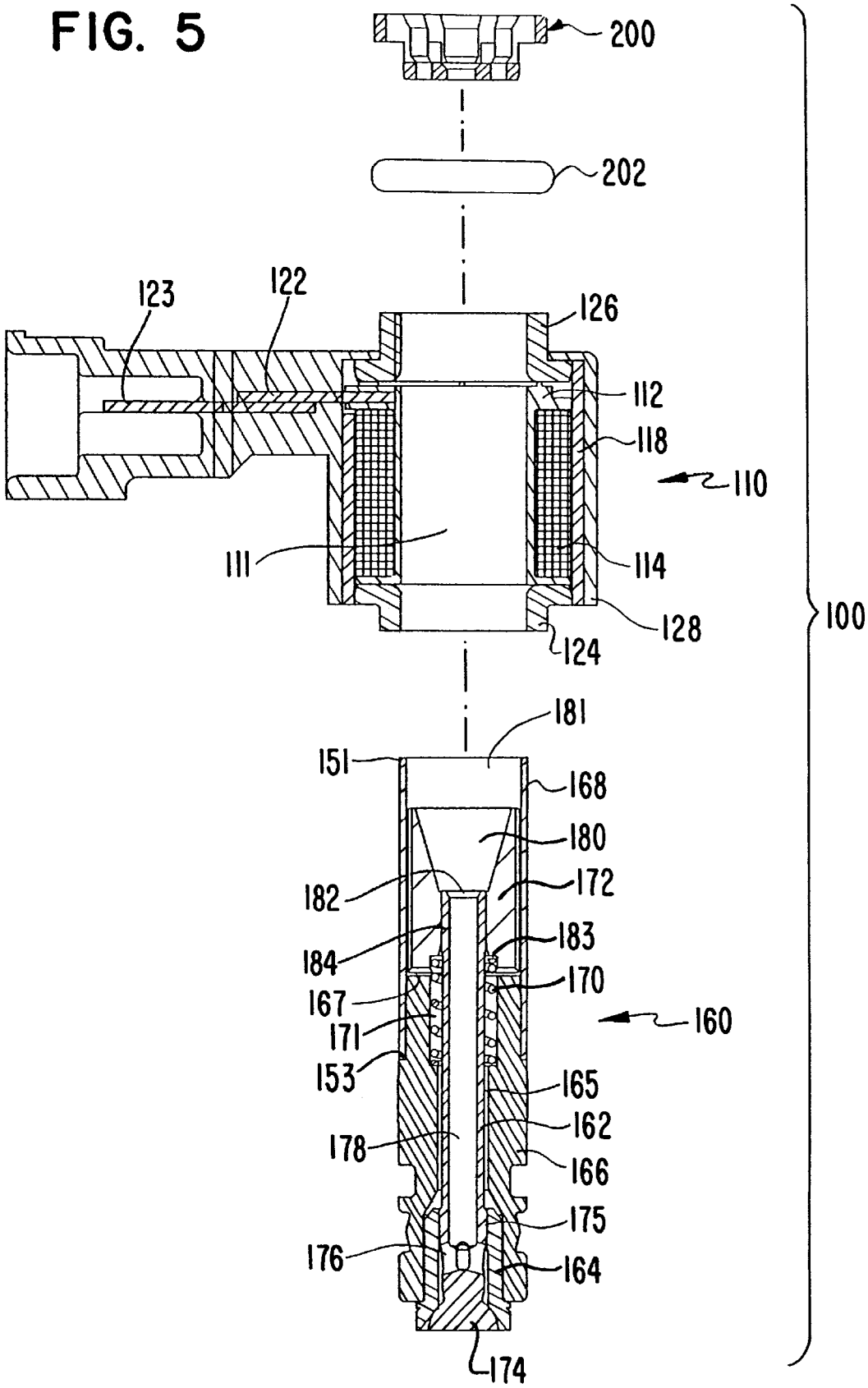
FIG. 5 is an exploded view of FIG. 4.

The air assist fuel injector 100 is configured to utilize pressurized gas to atomize low pressure liquid fuel, which together travel through air assist fuel injector 100 along a direction of flow f as indicated in FIGS. 3 and 4. As best illustrated by FIG. 5, the air assist fuel injector 100 includes two primary assemblies: a solenoid assembly 110 and a valve assembly 160.

The solenoid assembly 110 at least includes a coil 114 of conductive wire wrapped around a tubular bobbin 112. Coil 114 preferably includes a winding of insulated conductor that is wound helically around the bobbin 112. Coil 114 has two ends that are each electrically connected, such as soldered, to a terminal 122. Coil 114 is energized by providing current to connector 123, which is electrically connected to the terminal 122.

Although each solenoid assembly 110 includes the bobbin 112 and coil 114, alternative embodiments of the solenoid assembly 110 may include other items. For example, the solenoid assembly 110 may also include a casing 118, one or more retainers 124, 126, or other items. Additionally, although the preferred embodiments of solenoid assembly 110 include the items illustrated in FIGS. 4 and 5 further described below, it will be appreciated that alternative embodiments of the solenoid assembly 110 may include more or less of these items, so long as each solenoid assembly 110 includes a coil 114 and a bobbin 112. For example, solenoid assembly 110 may only include coil 114, bobbin 112, and casing 118.

Bobbin 112 of the solenoid assembly 110 is essentially a spool on which the conductor of the coil 114 is wound. Bobbin 112 also defines a throughhole 111, in which an armature 172 is electromagnetically actuated, as further described below. Bobbin 112 and coil 114 are located at least partially within a tubular casing 118, of soft magnetic steel. Hence, tubular casing 118 at least partially encases coil 114.

The solenoid assembly 110 also includes an upper retainer 126 and a lower retainer 124, which are annular bodies that partially close-off the ends of the casing 118. Upper retainer 126 and lower retainer 124 include a cylindrical passageway coincident with throughhole 111 of bobbin 112. The retainers 126, 124 of solenoid assembly 110 retain bobbin 112 and coil 114 in casing 118. The cylindrical passageway of the lower retainer 124 and the cylindrical passageway of the upper retainer 126 each receives at least a portion of valve assembly 160. Solenoid assembly 110 also includes an overmold 128 of insulative material, such as glass-filled nylon, that houses casing 118 and at least a portion of the upper and lower retainers 126, 124. The overmold 128 also houses the terminal 122 and a portion of the connector 123.

The valve assembly 160 of air assist fuel injector 100 defines the dynamic portion of the air assist fuel injector that functions as a valve to deliver the atomized quantity of liquid fuel and gas. As illustrated in FIG. 5, the preferred embodiment of the valve assembly 160 includes an armature 172, a poppet 162, a seat 164, a leg 166, a spring 170, and a sleeve 168. The armature 172 is formed of a ferromagnetic material, such as 430 FR stainless steel or similar, and functions as the moving part of an electromagnetic actuator, defined by the solenoid assembly 110 and armature 172 combination. As illustrated in FIG. 4, armature 172 of the air assist fuel injector 100 is located relative to the solenoid assembly 110 such that armature 172 is subject to the lines of magnetic flux generated by the solenoid assembly 110. Hence, armature 172 is actuated when the solenoid coil assembly 120 is energized. In the preferred embodiment, armature 172 is located partially within throughhole 111 of bobbin 112.

Armature 172 includes a passageway 180 that conveys a mixture of liquid fuel and gas to an inlet 182 of the poppet 162. In the preferred embodiment, the passageway 180 of armature 172 includes a conical conduit extending from a first end of armature 172 adjacent a cap 200 (described further below) to the inlet 182 of poppet 162. Inlet 182 is located at an approximate midpoint along the length of the armature 172. However, the passageway 180 may take other forms. For example, the passageway 180 may be one cylindrical passageway extending the entire length of armature 172, a plurality of passageways, or other configurations, as will be apparent. The preferred embodiment of the armature 172 includes grooves 169 in the cylindrical exterior surface of the armature and grooves 173 in the bottom face of the armature. As illustrated in FIG. 4, the grooves 169 in the cylindrical exterior surface of the armature extend the entire length of the armature 172. The grooves 169, 173 serve to relieve any pressure differential between an area upstream of the armature 172 and an area downstream of the armature. The grooves 169, 173 also help reduce surface adhesion between the armature 172 and the leg 166.

Poppet 162 is attached to armature 172, which is actuated by energizing the solenoid assembly 110. In the illustrated embodiment, armature 172 includes a cylindrical passageway located downstream of passageways 180 and matingly receives a first end portion 184 of poppet 162. Hence, inlet 182 is located immediately downstream of passageway 180 with respect to the direction of flow f of the mixture of liquid fuel and gas. The end portion 184 of the poppet 162 is attached to armature 172 with a welded connection, preferably a YAG laser weld. However, alternative attachments are also contemplated. For example, the poppet 162 may be attached to the armature 172 at any of a variety of locations with an interference fit, an adhesive, a threaded or screwed attachment, a lock and key attachment, a retaining ring attachment, an electron beam weld, an ultrasonic weld, or other known attachments. Because poppet 162 is attached to armature 172, poppet 162 will move with the armature 172 when the armature 172 is actuated by energizing the solenoid assembly 110. In alternative embodiments, passageway 180 extends between the upstream end face and the opposing, downstream end face of armature 172, i.e., the entire length of the armature, and the first end portion 184 of the poppet 162 is attached to the armature 172 at the downstream end face of the armature 172.

Poppet 162 is an elongated hollow tube for conveying the mixture of liquid fuel and pressurized gas, and includes a stem and a head 174. Inlet 182 of poppet 162 opens into a tubular passageway 178 which extends from inlet 182 to outlet 176, which is located just upstream of the head 174. In the preferred embodiment, poppet 162 includes four slot-shaped outlets 176 that are equally spaced from each other and located approximately transverse to the longitudinal axis of the poppet 162. Although preferred that poppet 162 have four slot-shaped outlets 176, other configurations will suffice. For example, poppet 162 may include one slot shaped outlet, two circular outlets, five oval outlets, or ten pin sized outlets.

The poppet head 174 is located downstream of outlet 176 and is roughly mushroom shaped with a conical or angled face that seats against the seat member 164 when the solenoid assembly 110 is not energized. When armature 172 is actuated by energizing solenoid coil assembly 120, poppet 162 moves with armature 172 such that head 174 is lifted off the seat member 164 in a direction away from air assist fuel injector 100. When head 174 is lifted off seat member 164, a seal is broken between head 174 and the seat member 164 such that liquid fuel and gas exiting outlets 176 exits the air assist fuel injector 100.

As also illustrated in FIG. 5, movement of poppet 162 is guided at a bearing 175 between poppet 162 and seat 164. Bearing 175 is located just upstream of outlet 176 with respect to the direction of flow f of the liquid fuel and gas through the injector 100. Hence, poppet 162 and seat member 164 each include a bearing face for guiding movement of the poppet 162 near the head end of poppet 162. Because seat member 164 serves as a bearing for poppet movement and also absorbs the impact of head 174 when the poppet valve assembly 160 opens and closes, the seat member 164 is preferably fabricated from a wear and impact resistant material, such as hardened 440 stainless steel.

As further illustrated in FIGS. 4 and 5, poppet 162 moves within the elongated channel 165 of leg 166. Leg 166 is an elongated body through which poppet 162 moves and which supports seat 164. The interior channel 165 of leg 166 through which poppet 162 moves also serves as a secondary flow path for the pressurized gas. Hence, when the head 174 lifts off the seat member 164, pressurized gas flows outside poppet 162 but inside the leg 166 to help atomize the liquid fuel and gas exiting outlet 176.

The spring 170 of valve assembly 160 is located between armature 172 and leg 166. More particularly, spring 170 sits within a recessed bore or cavity 171 that is concentric with the elongated channel 165 of the leg 166. Bore 171 faces armature 172 and defines a seat for spring 170. Spring 170 is a compression spring having a first end that abuts armature 172 and a second end that abuts leg 166. The bottom of bore 171 defines the seat for the downstream end of spring 170 and a recess 183 defines a seat for the upstream end of spring 170. The spring 170 functions to bias armature 172 away from leg 166. When solenoid assembly 110 is not energized, spring 170 biases armature 172 away from leg 166 and thus poppet 162 is maintained in a closed position where the head 174 abuts against seat member 164. However, when solenoid assembly 110, is energized, the electromagnetic force causes armature 172 to overcome the biasing force of spring 170 such that armature 172 moves toward the leg 166 until it abuts a stop surface 167 of leg 166. When the solenoid assembly 110 is de-energized, the electromagnetic force is removed and spring 170 again forces armature 172 away from stop surface 167.

As illustrated in FIG. 4, the armature 172 is received by the sleeve 168, which is a cylindrical tube that extends at least a portion of the length of armature 172. The sleeve 168 may take other shapes. For example, the sleeve 168 may include two or more different diameters to accommodate differently sized caps and legs. Movement of the armature 172 is preferably guided by a bearing 161 between the outer surface of the armature 172 and the inner surface of the sleeve 168. Hence, the passageway 181 of the sleeve 168 receives the armature 172 and slidably engages the armature 172. In an alternative embodiment, the interior surface of the sleeve 168 does not slidably engage the armature 172 and thus does not serve as a bearing surface for the armature. In this alternative embodiment, the air assist fuel injector may include an additional bearing at the poppet, similar to the bearing 175.

The sleeve 168 is located between solenoid assembly 110 and the armature 172 so as to seal the solenoid assembly 110 from the liquid fuel and gas. Hence, the sleeve 168 has a first end 151 located upstream of armature 172 with respect to the direction of flow f and a second end 153 located downstream of the armature 172 with respect to the direction of flow f such that the sleeve 168 seals the solenoid assembly 110 from the liquid fuel and gas flowing through the air assist fuel injector 100. To seal the solenoid assembly 110 from the liquid fuel and gas in the air assist fuel injector, the second end 153 of sleeve 168 is sealingly attached to leg 166, preferably by a hermetic YAG laser weld. However, the sleeve 168 may be sealingly attached to the leg by other attachments, such as by a braze, ultrasonic weld, adhesive, electron beam weld, etc. As illustrated in FIG. 4, the passageway 181 of the sleeve 168 receives the leg 166 at the second end 153 of the sleeve, which is attached to the leg 166. However, in alternative embodiments, the sleeve 168 does not receive the leg 166. For example, the leg 166 may include a cavity that receives the sleeve 168. Alternatively, the second end 153 of the sleeve 168 may be sealingly attached to the stop surface 167 of the leg 166. Furthermore, the sleeve 168 need not be attached to the leg 166 at the second end 153. For example, if the leg 166 includes a cavity that receives the sleeve 168, the sleeve 168 may be attached to the leg 166 at a point upstream of the second end 153 with respect to the direction of flow f .

The air assist fuel injector 100 also includes a cap 200 that defines an inlet to the air assist fuel injector 100 for the pressurized gas and liquid fuel. The cap 200 is the interface between the rail 500 and the air assist fuel injector 100, and serves to direct the liquid fuel and gas to the passageway 180 of the armature 172. As illustrated in FIGS. 7 and 8, cap 200 includes at least one fuel passageway 210 having an inlet that receives liquid fuel and at least one gas passageway 212 having an inlet that receives pressurized gas. In the illustrated embodiment of the air assist fuel injector 100, the cap 200 includes only one cylindrical liquid fuel passageway 210 located along the center axis of the cap, and four cylindrical gas passageways 212 circumferentially and equally spaced about the liquid fuel passageway 210. In alternative embodiments, the cap may have more or less passageways 210, 212. For example, the cap may have two gas passageways 212 and two fuel passageways 210.

As illustrated in FIG. 4, the sleeve 168 matingly receives at least a portion of the cap 200, preferably such that the outlets of the passageways 210, 212 are located within the passageway 181 of the sleeve 168 so as to direct the liquid fuel and gas to the passageway 180 of the armature 172.

As described further below, to complete the seal that separates the solenoid assembly 110 from the liquid fuel and gas, the outer or exterior surface of the sleeve 168 near the first end 151 serves as a sealing surface for a seal member 202 such that, when the air assist fuel injector 100 is mounted to a rail, the sealed sleeve 168 separates the solenoid assembly 110 from the liquid fuel and gas traveling through the air assist fuel injector 100.

The air assist fuel injector 100 utilizes pressurized air to atomize low pressure fuel. When installed in an engine, the air assist fuel injector 100 is located such that the atomized low pressure fuel that exits the air assist fuel injector 100 is delivered to the internal combustion chamber of an engine, i.e., the part of an engine in which combustion takes place, normally the volume of the cylinder between the piston crown and the cylinder head, although the combustion chamber may extend to a separate cell or cavity outside this volume. For example, the air assist fuel injector 100 may be located in a cavity of a two stroke internal combustion engine head such that the air assist fuel injector can deliver a metered quantity of atomized liquid fuel to a combustion cylinder of the two stroke internal combustion engine, where it is ignited by a spark plug or otherwise.

Figure 6:
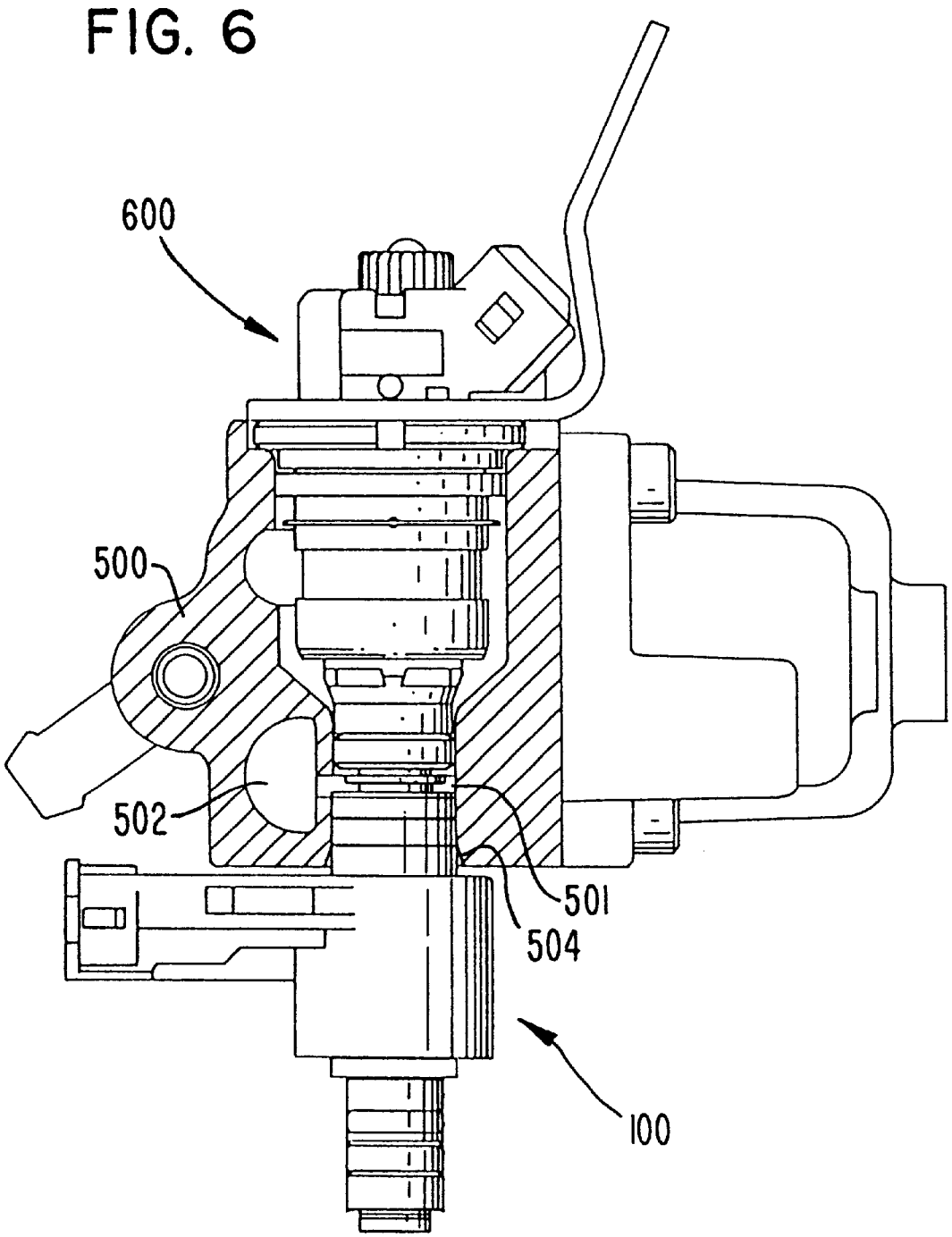
FIG. 6 is a cross-sectional view of a rail holding a fuel injector and mounted to the air assist fuel injector illustrated in FIG. 1.

As illustrated by FIG. 6 the air assist fuel injector 100 is located adjacent a conventional fuel injector 600. The fuel injector 600 is located at least partially in a cavity of a rail 500 configured for a two stroke engine. The fuel injector 600 and rail 500 together define a rail assembly that delivers liquid fuel and gas to the cap 200 of the air assist fuel injector 100. Examples of fuel injector 600 that are suitable for delivering liquid fuel to the air assist fuel injectors include any top or bottom feed manifold port injector, commercially available from Bosch, Siemens, Delphi, Keihin, Sagem, Magnetti Marelli, or other multi-point fuel injector suppliers. The rail 500 includes one or more internal passageways or external lines (not illustrated) that deliver liquid fuel to the fuel injector 600, as well as one or more passageways 502 that deliver pressurized gas, preferably air, to the air assist fuel injector 100.

The air assist fuel injector 100 is referred to as "air assist" because it preferably utilizes pressured air to atomize liquid fuel. In the illustrated embodiments, the pressure of the air is at roughly 550 KPa for two stroke applications and at roughly 650 KPa for four stroke applications, while the pressure of the liquid fuel is roughly between 620 and 1500 KPa and is always higher than the air pressure. Preferably, the fuel pressure is between 620 and 800 KPa. Although it is preferred that the air assist fuel injector atomize liquid gasoline with pressurized air delivered by the air/fuel rail, it will be realized that the air assist fuel injector 100 may atomize many other liquid combustible forms of energy with any of a variety of gases. For example, the air assist fuel injector 100 may atomize liquid kerosene or liquid methane with pressurized gaseous oxygen, propane, or exhaust gas. Hence, the term "air assist" is a term of art, and as used herein is not intended to dictate that the air assist fuel injector 100 be used only with pressurized air.

The rail 500 also defines a mount for air assist fuel injector 100. That is, the rail 500 abuts against at least one surface of the air assist fuel injector 100 to retain the air assist fuel injector 100 in place. In the illustrated embodiment, the rail 500 includes a cavity 504 that matingly receives the seal member 202. Hence, the cavity 504 of the rail 500 also receives at least a portion of the cap 200 and the sleeve 168. The conventional fuel injector 600 is configured and located relative to the cap 200 such that it delivers a metered quantity of liquid fuel directly to the inlet at the cap 200 of the air assist fuel injector 100. Hence, cap 200 receives the pressurized gas and liquid fuel from the rail assembly. Because of the proximity of the outlet of the fuel injector 600 to the cap 200, the majority of the liquid fuel exiting from fuel injector 600 will enter the fuel passageway 210. The pressurized gas is delivered to cap 200 via an annular passageway 501 in rail 500. The majority of the pressurized gas conveyed by rail 500 will thus enters the gas passageways 212 of the cap 200. Hence, cap 200 functions as an inlet to air assist fuel injector 100 for the pressurized gas and liquid fuel.

As illustrated in FIG. 6, the interface between the air assist fuel injector 100 and the rail 500 is sealed via the seal member 202. Hence, the seal member 202 defines a seal at least between a surface of the rail 500 and the exterior surface of the sleeve 168. The seal member 202 is preferably a toroidal ring of circular cross-section made of rubber, neoprene, polypropylene, or similar material that fits into a radial groove to provide sealing between the rail 500 and the sleeve 168. In the preferred embodiment, the seal member 202 abuts the cylindrical and exterior surface of the sleeve 168, the interior and cylindrical surface of the rail cavity 504, a surface 214 of the cap 200, and a surface of the upper retainer 126. Hence, the radial groove in which the o-ring is located is defined by the cap 200, the sleeve 168, and the upper retainer 126. In alternative embodiments, the seal member 202 only abuts the sleeve 168 and one or more surfaces of the rail 500. For example, the cavity 504 of the rail 500 may include a recess or groove that receives the seal member 202 such that an interface seal is formed when the sleeve 168 is inserted into the cavity 504. Additionally, the sleeve 168 may include a recess or groove that receives a portion of the seal member 202 such that the seal member 202 only abuts the sleeve 168 and the cavity 504. In further embodiments, the seal member 202 may be a gasket seal, a packing seal, a multiple component seal, etc.

As is also illustrated in FIG. 6, the seal member 202 defines a radial seal with the rail 500. That is, the seal member 202 defines a radial seal by abutting a surface of the cavity 504 that is parallel with the center axis C of the air assist fuel injector 100. Because the interface seal is preferably a radial seal, it is less likely that the interface seal will leak when subject to vibrations, such as those associated with many internal combustion engines.

As is apparent from the foregoing description, the sealing arrangement of the air assist fuel injector 100 seals the solenoid assembly 110 from the liquid fuel and gas, and also seals the interface between the air assist fuel injector 100 and the rail 500. This preferred sealing arrangement advantageously uses only one sealing member 202 and is more compact than sealing arrangements of conventional air assist fuel injectors having interface caps and configured for similar applications.

After the pressurized gas and liquid fuel enters the cap 200, the pressurized gas and the liquid fuel mixture exits cap 200 and enters armature 172 located immediately downstream of cap 200 with respect to the direction of flow f. The liquid fuel and pressurized gas mix in passageway 182 of armature 172 and are conveyed to inlet 182 of poppet 162. Thereafter, the liquid fuel and gas travel through tubular passageway 178 of poppet 162. When the solenoid assembly 110 is energized, armature 172 overcomes the biasing force of spring 170 and moves toward leg 166 until it seats against stop surface 167. Because poppet 162 is attached to armature 172, head 174 of poppet 162 lifts off of the seat in the direction of flow f when armature 172 is actuated. When head 174 lifts off of seat 164, a seal between the head and the seat is broken and the gas and fuel mixture exits the outlet 176. The mixture exiting the set of outlets 176 is then forced out of air assist injector 100 over the head 174 such that a metered quantity of atomized liquid fuel is delivered to combustion chamber of an engine.

When the previously described solenoid assembly 110 is de-energized, the biasing force of spring 170 returns armature 172 to its original position. Because poppet 162 is attached to armature 172, the head 174 of poppet 162 returns to seat 164 to define a seal that prevents further gas and fuel from exiting air assist fuel injector 100. Hence, air assist fuel injector 100 atomizes the liquid fuel supplied by conventional fuel injector 600 with the pressurized gas supplied via the rail 500. The atomized fuel is then delivered to a combustion chamber of an engine, where it is ignited to power the engine.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. An air assist fuel injector, comprising:

a cap having a plurality of passageways for conveying liquid fuel and gas, each of said passageways having an inlet and an outlet;

an armature;

a solenoid having a throughhole;

a poppet attached to said armature;

a leg having a channel that receives at least a portion of said poppet; and a sleeve sealingly attached to said leg at an attachment location and extending through said throughhole from said attachment location to a location upstream of said armature with respect to a direction of flow of liquid fuel and gas through said air assist fuel injector, said sleeve having a passageway that receives at least a portion of said armature and said cap, said outlets of said passageways of said cap being within said passageway of said sleeve.

2. The air assist fuel injector of claim 1, said sleeve receiving at least a portion of said leg.

3. The air assist fuel injector of claim 1, said sleeve slidably engaging said armature.

4. The air assist fuel injector of claim 1, in combination with a rail assembly for delivering the liquid fuel and gas to said cap, said rail assembly having a cavity that receives a portion of said sleeve.

5. The air assist fuel injector of claim 4, further comprising:

a seal member defining a seal between said sleeve and said rail assembly.

6. The air assist fuel injector of claim 5, said seal member including an o-ring.

7. The air assist fuel injector of claim 5, said seal member abutting said sleeve and a surface of said rail assembly.

8. The air assist fuel injector of claim 7, said seal member abutting a surface of said cap.

9. The air assist fuel injector of claim 1, said sleeve being a cylindrical tube.

10. An air assist fuel injector, comprising:

a cap having a plurality of passageways for conveying liquid fuel and gas, each of said passageways having an inlet and an outlet;

an armature;

a solenoid for actuating said armature;

a poppet attached to said armature;

a leg having a channel that receives at least a portion of said poppet;

an entirely cylindrical sleeve sealingly attached to said leg and having a passageway that receives at least a portion of said cap; and a seal member abutting a cylindrical and exterior surface of said sleeve.

11. The air assist fuel injector of claim 10, in combination with a rail assembly for delivering the liquid fuel and gas to said cap, said seal member abutting a surface of said rail assembly.

12. The air assist fuel injector of claim 10, said sleeve slidably engaging said armature.

13. The air assist fuel injector of claim 10, said seal member abutting said cap.

14. The air assist fuel injector of claim 10, said sleeve being laser welded to said leg.

15. An assembly, comprising:

a seal member;

a rail assembly for delivering liquid fuel and gas;

an air assist fuel injector having:

a cap for receiving liquid fuel and gas from said rail assembly;

an armature;

a solenoid for actuating said armature;

a poppet attached to said armature;

a leg adjacent said armature having a channel that receives at least a portion of said poppet; and a sleeve having an entirely cylindrical periphery, being sealingly attached to said leg, and having a passageway that receives said armature and at least a portion of said cap, said seal member defining a radial seal between said sleeve and a surface of said rail assembly.

16. An air assist fuel injector comprising:

a cap having a plurality of passageways for conveying liquid fuel and gas;

an armature;

a solenoid coil wrapped around a bobbin, said bobbin having an interior surface that defines a throughhole through said bobbin;

a poppet attached to said armature;

a leg having a channel that receives said poppet; and a sleeve that receives said cap and that is located and configured to prevent liquid fuel and gas traveling through said air assist fuel injector from contacting said interior surface of said bobbin.

17. The air assist fuel injector of claim 16, said sleeve receiving at least a portion of said leg.

18. The air assist fuel injector of claim 16, said sleeve being sealingly attached to said leg.

19. The air assist fuel injector of claim 18, said sleeve being sealingly attached to said leg at an end of said sleeve.

20. The air assist fuel injector of claim 18, said sleeve consisting of an entirely cylindrical tube.

21. The air assist fuel injector of claim 16, in combination with a rail assembly for delivering liquid fuel and gas to said air assist fuel injector.

22. The air assist fuel injector of claim 21, further comprising:

a seal member defining a radial seal between said sleeve and said rail assembly.

23. An air assist fuel injector comprising:

a cap having a plurality of passageways for conveying liquid fuel and gas;

an armature;

a solenoid coil wrapped around a bobbin, said bobbin having an interior surface that defines a throughhole;

a poppet attached to said armature;

a leg having a channel that receives said poppet; and means for preventing liquid fuel and gas traveling through said air assist fuel injector from contacting said interior surface of said bobbin, said preventing means including a sleeve that receives liquid fuel and gas from said cap.

24. An air assist fuel injector comprising:

a cap having a plurality of passageways for conveying liquid fuel and gas;

an armature;

a solenoid coil wrapped around a bobbin, said bobbin having an interior surface that defines a throughhole;

a body having a channel that receives said poppet; and a sleeve located between said bobbin and said armature so as to isolate said interior surface from liquid fuel and gas traveling through said air assist fuel injector.

25. An air assist fuel injector comprising:

a cap having a plurality of passageways for conveying liquid fuel and gas;

an armature;

a solenoid assembly having a throughhole;

a poppet attached to said armature;

a leg having a channel that receives said poppet; and a sleeve sealingly attached to said leg, located and configured to receive liquid fuel and gas from said cap, and having a first portion located upstream of said armature with respect to a direction of flow of liquid fuel and gas through said air assist fuel injector and a second portion located downstream of said armature with respect to said direction of flow, at least said second portion being located within said throughhole.

26. The air assist fuel injector of claim 25, said sleeve being composed of an entirely cylindrical tube.

27. The air assist fuel injector of claim 25, said sleeve being sealingly attached to said leg at an end of said sleeve.

28. The air assist fuel injector of claim 27, said end of said sleeve being located within said throughhole.

29. The air assist fuel injector of claim 25, in combination with a rail assembly for delivering liquid fuel and gas to said air assist fuel injector, further comprising a seal member defining a radial seal between said sleeve and said rail assembly.

30. An air assist fuel injector comprising:

a cap having a plurality of passageways for conveying liquid fuel and gas;

an armature;

a solenoid having a throughhole, said throughhole having an interior surface and a longitudinal center axis;

a poppet attached to said armature;

a leg having a channel that receives at least a portion of said poppet; and a sleeve sealingly attached to said leg and having a passageway that receives at least a portion of said armature and said cap, a portion of said sleeve being located within said throughhole and being located radially inward of a most radially inward portion of said interior surface as measured with respect to said longitudinal center axis.

* * * * *